US007481195B2

(12) United States Patent
Nelson

(10) Patent No.: US 7,481,195 B2
(45) Date of Patent: Jan. 27, 2009

(54) ICE AND FLYWHEEL POWER PLANT

(76) Inventor: Rodney Nelson, 452 Toler Rd., Princeton, NC (US) 27569

( * ) Notice: Subject to any disclaimer, the term of this patent is extended or adjusted under 35 U.S.C. 154(b) by 89 days.

(21) Appl. No.: 11/627,966

(22) Filed: Jan. 27, 2007

(65) Prior Publication Data

US 2008/0178835 A1 Jul. 31, 2008

(51) Int. Cl.

| | |
|---|---|
| ***F02B 75/22*** | (2006.01) |
| ***F02B 75/32*** | (2006.01) |
| ***F02B 19/00*** | (2006.01) |
| ***F02F 1/42*** | (2006.01) |

(52) U.S. Cl. ..... 123/193.5; 123/192.2; 123/197.1; 123/260; 123/261; 123/55.5

(58) Field of Classification Search ..... 123/197.1, 123/585, 55.5, 192.2, 68, 69 R, 70 R, 71 R, 123/193.5, 253, 286, 291, 293
See application file for complete search history.

(56) References Cited

U.S. PATENT DOCUMENTS

| | | | | | |
|---|---|---|---|---|---|
| 1,687,744 | A | | 10/1928 | Webb | |
| 4,312,306 | A | | 1/1982 | Bundrick, Jr. | |
| 4,395,977 | A | | 8/1983 | Pahis | |
| 4,476,821 | A | * | 10/1984 | Robinson et al. | 123/68 |
| 4,485,768 | A | | 12/1984 | Heniges | |
| 4,608,951 | A | | 9/1986 | White | |
| 4,854,274 | A | * | 8/1989 | Dingess | 123/192.1 |
| 4,864,976 | A | | 9/1989 | Falero | |
| 4,907,548 | A | * | 3/1990 | Lee | 123/197.3 |
| 5,139,124 | A | * | 8/1992 | Friedmann | 192/48.3 |
| 5,673,665 | A | * | 10/1997 | Kim | 123/197.1 |
| 5,809,864 | A | | 9/1998 | Ashton | |
| 5,884,590 | A | | 3/1999 | Minculescu | |
| 6,067,973 | A | * | 5/2000 | Chanda et al. | 123/585 |
| 6,619,244 | B1 | | 9/2003 | Ho | |
| 6,827,058 | B1 | | 12/2004 | Falero | |
| 2006/0137520 | A1 | | 6/2006 | Raffaele et al. | |

FOREIGN PATENT DOCUMENTS

| | | | | |
|---|---|---|---|---|
| DE | 3019288 | A | * | 11/1981 |
| DE | 3531862 | A1 | * | 3/1987 |
| JP | 02107844 | A | * | 4/1990 |
| JP | 11303938 | A | * | 11/1999 |
| RU | 2078943 | C1 | * | 5/1997 |

* cited by examiner

*Primary Examiner*—Noah Kamen
(74) *Attorney, Agent, or Firm*—Louis Ventre, Jr.

(57) ABSTRACT

A reciprocating internal combustion engine has an engine block (100) with at least one pair of coaxially aligned cylinders (30L and 30R) in which a dual-headed piston body reciprocates. Two rack gears (27 and 28) are mounted within a central frame structure (40) of the piston body and mesh with two pinion gears (29*a* and 29*b*, respectively). The pinion gears are rotatably mounted on an axle (21) oriented approximately perpendicular to the line of reciprocate motion of the piston. A slip clutch (23*a* and 23*b*) on each pinion gear alternatively locks and unlocks the pinion gear to the axle to permit rotation of the axle in one direction as the piston reciprocates. Preferably, fuel combustion occurs alternatively in each cylinder head. A valved chamber (34L and 34R) in the cylinder head enables exhaust. Preferably, a flywheel (49) is connected to the axle.

11 Claims, 3 Drawing Sheets

ICE AND FLYWHEEL POWER PLANT

FIELD OF INVENTION

In the field of power plants, a reciprocating internal combustion engine and a combination of the engine and a flywheel for vehicular and other uses that reduces environmental pollution and improves efficiency by extracting more energy from the products of combustion and storing it for efficient use.

DESCRIPTION OF PRIOR ART

The invention is a reciprocating internal combustion engine that is a variation and improvement to Scotch yoke type engines, which were first developed circa 1900. The invention is further a combination of the reciprocating internal combustion engine and a flywheel.

The scotch-yoke engine concept uses two horizontally opposed cylinders with a single piston having a central yoke. An axle that is perpendicular to the axis of the cylinders and through the central yoke is rotated by one of two types of means to convert the cyclical back and forth movement of the cylinder to rotational energy of a drive shaft.

The first type of means to convert cyclical movement to rotational energy is an orbiting internally-toothed roller gear usually with an ovate shape that is moved to maintain contact with a fixed drive gear on the axle. The second type uses rocker arms, cam rotations or offset crankpins to rotate a crankshaft.

U.S. Pat. No. 4,864,976 to Avelino Falero is an example of prior art using an internally-toothed roller gear orbiting within the yoke structure. The roller gear moves within the yoke or piston frame structure to maintain constant engagement with a gear on a rotating axle at the center of the yoke structure.

U.S. Pat. No. 4,485,768 to William B. Heniges is an example of the second kind of scotch yoke engine: one with an offset crankpin. The '768 patent discloses a slider within a central yoke raceway having straight segments and curved segments. The slider imparts rotation to the crankshaft with an offset crankpin.

The present invention is different from the '976 and '768 patents in that it has no central roller gear with internal teeth or any slider employing an offset crankpin. The present invention does not use a connecting rod for transmitting energy from the piston to an axle or crankshaft.

The present invention is a much simpler design using two fixed-position rack gears on the piston frame structure that engage two pinion gears on the axle. Two pinion gears on the axle continuously engage the rack gears, but only one pinion gear engages the axle at a time. A clutch on each pinion gear alternatively locks and unlocks its pinion gear to the axle. The use of a clutch permits piston motion in either direction to convert to rotational motion of the axle in a single direction. For example, combustion in the left cylinder causes rectilinear motion of the piston to the right. Prior to movement to the right a clutch on the pinion gear locks that pinion gear to the axle to rotate the axle in a clockwise direction, while the other pinion gear is unlocked and rotates without engaging the axle. When the piston stops at the end of its travel in the cylinder, the clutches reverse with the previously engaged pinion gear unlocking and the previously unlocked gear engaging the axle. Then, when the other cylinder fires, rectilinear motion of the piston to the left again rotates the axle in a clockwise direction. Slip clutches are well known and a preferred slip clutch uses a one-way bearing, which allows rotation in one direction only and nearly zero backlash when rotational force is reversed.

In contrast to the '976 patent, the present invention has no complex yoke mechanism and consumes no energy in moving a roller gear around a fixed gear. Also, in contrast to the '768 disclosure, the full linear motion of the piston is used to rotate the axle, rather than simply limited to that imparted to the axle from the slider and crankpin. Finally, the present invention needs no compression stroke or the attendant energy consumption incident thereto. Because a single body piston is used in the invention, every stroke of the piston is a power stroke.

The limitation of existing designs is illustrated by considering that a crankshaft in a 4-inch bore engine is limited to less than 4 inches of expansion, which is why the exhaust gas temperature is typically over 700 degrees Fahrenheit. Gases at this temperature have lots of energy that is wasted by limited expansion. A practical model of the present invention utilizes more than triple the expansion of the example; thus, extracting more energy and further cooling the gas.

Unlike the prior art, the preferred embodiment of the present invention combusts fuel in the cylinder head and not in the volume of the cylinder enclosed by the head and the piston when the piston is closest to the head. The cylinder head has a smaller combustion chamber that is ported to the cylinder volume above the piston. This unique design of the cylinder head requires no compression stroke for the piston and enables additional combustion at any stage of the power stroke, if needed. The gearing, flexibility in combustion and the lack of a compression stroke translate to an ability to add more energy to the piston to respond to load variations and extract more energy from the expansion of the products of combustion.

Unlike the prior art, the preferred embodiment of the present invention employs a high concentration of oxygen for combustion in combination with a flywheel. Fuels burned with oxygen deliver more heat and are more completely combusted to minimize nitrous oxides pollutants and particulates. These features significantly improve power conversion efficiency, enable the use of a wide variety of fuels, and reduce air pollution from operating the engine. The oxygen is obtained from either a molecular air filter or sieve to concentrate oxygen or from a liquid oxygen tank. The flywheel is attached to the axle and stores the energy produced. The stored energy is the source of all power needed for vehicle propulsion and other uses.

Accordingly, the present invention and its alternative embodiments will serve to improve the prior art by providing a rack and pinion gearing mechanism that greatly improves the efficiency of converting rectilinear piston motion to axle rotation. The simplicity of the present invention for transmitting energy from the piston to an axle eliminates complex central orbiting roller gears, cams and connecting rods in the prior art. Providing for combustion of fuel in the cylinder head, eliminates a compression stroke for the piston and enables additional combustion at any stage of the power stroke. Finally, incorporating a flywheel and the use of a high concentration of oxygen for combustion enables use of a variety of fuels, reduces air pollution from operating the engine and minimizes waste by efficiently storing the energy produced.

BRIEF SUMMARY OF THE INVENTION

A reciprocating internal combustion engine has an engine block with a pair of coaxially aligned cylinders in which a dual-headed piston body reciprocates. Two rack gears are mounted within a central frame structure of the piston body and mesh with two pinion gears. The pinion gears are rotatably mounted on an axle oriented approximately perpendicular to the line of reciprocate motion of the piston. A slip clutch on each pinion gear alternatively locks and unlocks the pinion gear to the axle to permit rotation of the axle in one direction as the piston reciprocates. Preferably, a cylinder head at opposing ends of the aligned cylinders has a chamber for fuel combustion that is flowably connected to its cylinder. A second chamber in the cylinder head with a valve enables the combustion gases to exhaust when the piston returns to the head. Preferably, a flywheel is connected to the axle to rotate in the same direction as the rotation of the axle. Preferably, a molecular filter concentrates oxygen from the air for combustion in the cylinder heads. A second flywheel is optionally connected to the axle with a geared connection to rotate in a direction opposite to the direction of rotation of the axle to counter precessional forces of the first flywheel.

BRIEF DESCRIPTION OF THE DRAWINGS

Referring now to the drawings in which like reference numbers represent corresponding parts throughout.

DETAILED DESCRIPTION

In the following description, reference is made to the accompanying drawings, which form a part hereof and which illustrate embodiments of the present invention. The drawings and the preferred embodiments of the invention are presented with the understanding that the present invention is susceptible of embodiments in many different forms and, therefore, other embodiments may be utilized and structural and operational changes may be made without departing from the scope of the present invention.

Figure 1:
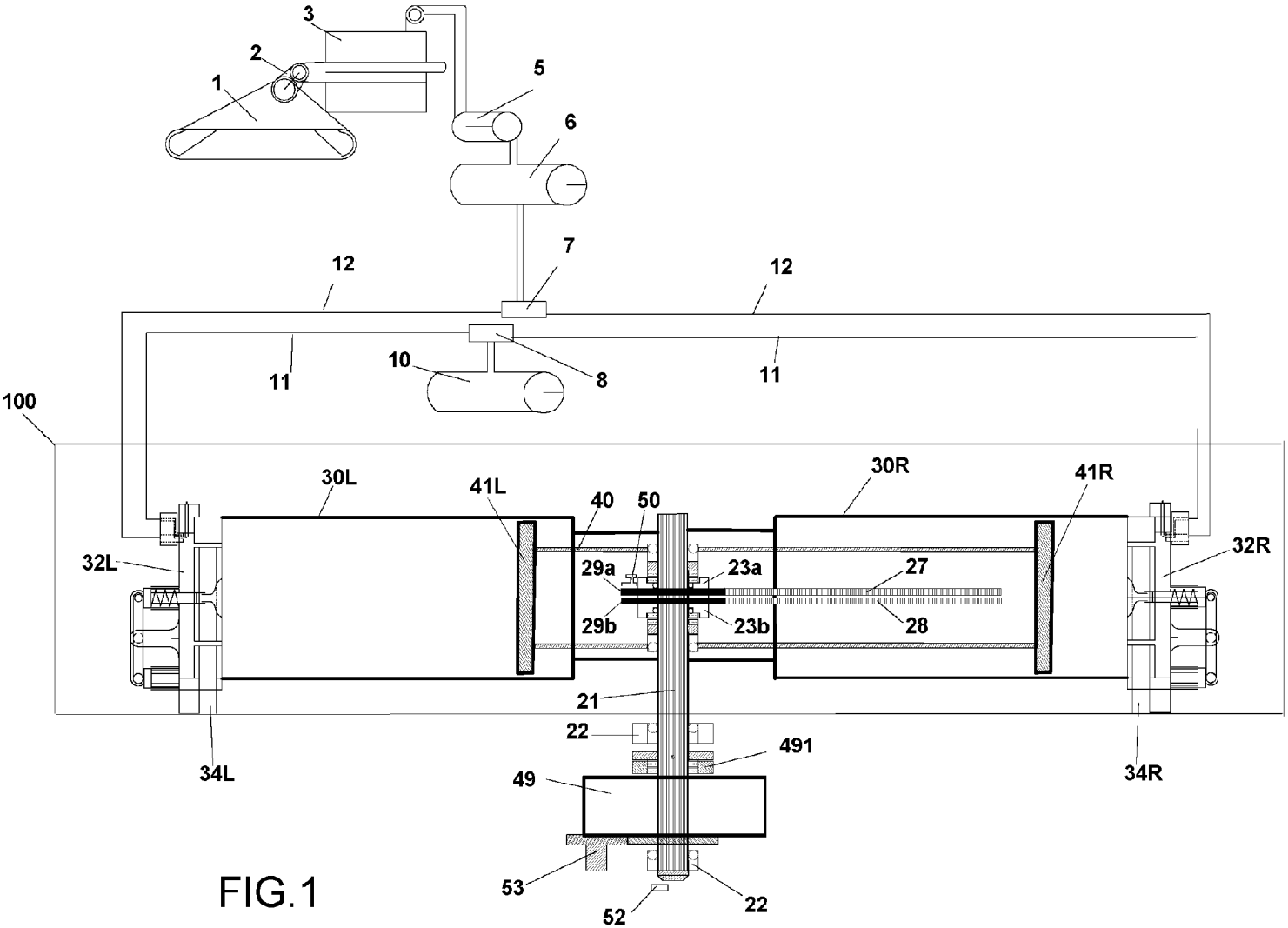
FIG. 1 is a top view and schematic of the preferred embodiment of the engine.

FIG. 1 will aid in disclosing a preferred embodiment of the invention, which generally shows a reciprocating internal combustion engine in combination with a flywheel (49). The internal combustion engine has an engine block (100) to hold at least one pair of coaxially aligned cylinders (30L and 30R).

The engine has a dual-headed piston body composed of a first piston head (41R) and second piston head (41L) attached to opposite ends of a central frame structure (40). The first piston head (41L) and the second piston head (41R) are adapted to reciprocate within their respective cylinders (30L and 30R) of the pair of coaxially aligned cylinders.

Figure 3:
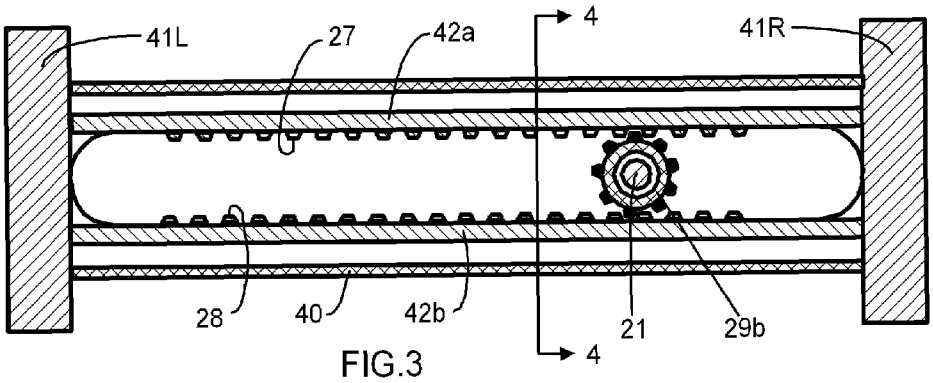
FIG. 3 is a longitudinal sectional view of the piston body, axle and gearing.
Figure 4:
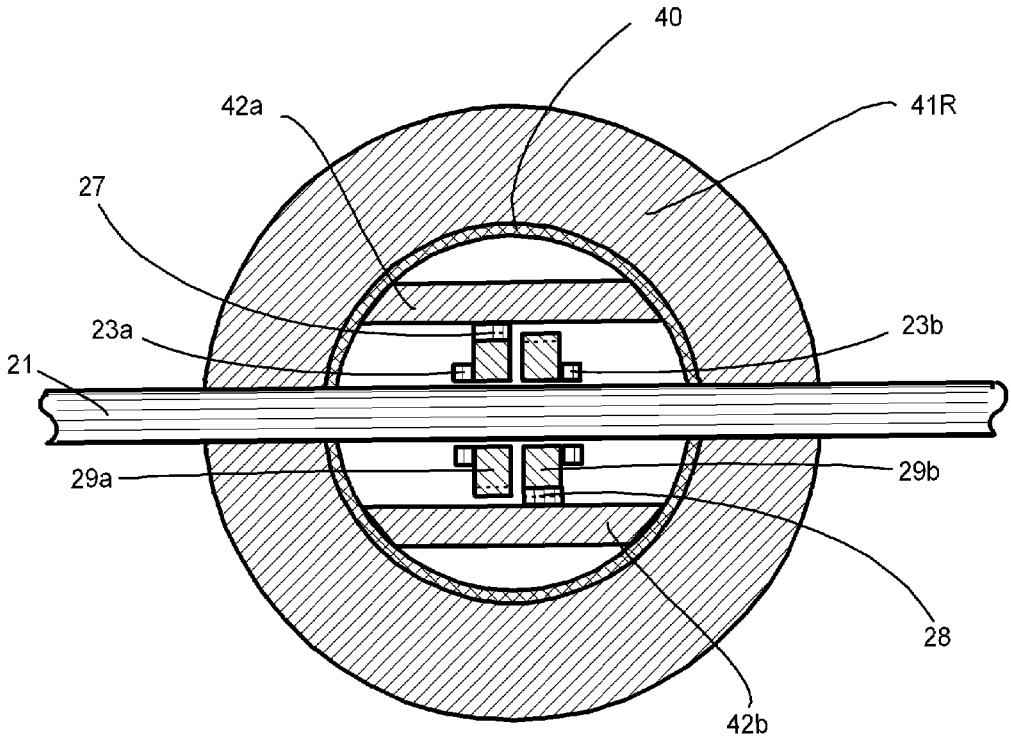
FIG. 4 is an end sectional view of the piston body, axle and gearing.

FIG. 3 is a side sectional view showing the piston body, axle and gearing. FIG. 4 is an end sectional view taken at the location identified in FIG. 3. Two mounting plates or frame segments (42*a* and 42*b*) span the central frame structure (40) of the piston body and serve as the mounting platforms for rack gears (27 and 28). An upper horizontal mounting plate (42*a*) holds the upper rack gear (27) and a lower horizontal mounting plate (42*b*) holds the lower rack gear (28). Each rack gear (27 and 28) meshes with a pinion gear (29*a* and 29*b*, respectively), each rotatably mounted on an axle (21). The axle (21) is journaled with bearings (22) to turn about a fixed axis and oriented approximately perpendicular to the line of reciprocate motion of the piston body. The rotatable mounting of the pinion gears is such that both pinion gears move freely in either rotational direction. A slip clutch (23*a* and 23*b*) for each pinion gear (29*a* and 29*b*, respectively) is adapted to alternatively lock to the axle (21) to permit rotation of the axle in one direction, and preferably in only one direction, as the piston reciprocates.

FIG. 1 shows a flywheel (49) connected to the axle (21) to rotate in the same direction as the rotation of the axle (21). A flywheel slip clutch (491) enables control of the speed of the flywheel (49) by engaging or disengaging the axle (21) from the flywheel (49). In operation of the preferred embodiment, the axle (21) imparts torque to flywheel (49) through a slip clutch (23*a* or 23*b*) where an output shaft (53) is geared to the flywheel (49). When the output shaft (53) is driving a hydraulic pump or varying loads on a generator, infinitely variable speeds or torque are available from the flywheel (49).

The engine is intended for at least one application in a transportation vehicle. It is well known that a rotating body such as a flywheel resists changes in direction, which may be counterproductive in a vehicle application. Known as precession or gyroscopic precession, this resistance manifests as a twisting force on the axis of a rotating body resulting from any applied tipping force, or force which changes the direction of the spinning body. In a preferred embodiment of the invention used in a vehicle, the forces inherent in precession are utilized to aid in steering the vehicle by hydraulically repositioning the axis of the flywheel with one or more hydraulic cylinders. In this manner, precessional forces counteract some of the inertial forces experienced when turning a vehicle.

An alternative embodiment used in a vehicle, includes a means to minimize or counteract precession resulting from a change in direction of a rotating flywheel. This means is a second flywheel that is geared to the axle to rotate in a direction opposite to the direction of rotation of the axle and the first flywheel. The second flywheel may be in any convenient location, such as adjacent to the first flywheel or at the opposite end of the axle. In each case, a well known and simple two-gear connection would enable the rotation of the axle to rotate the second flywheel in a direction opposite to that of the first flywheel.

FIG. 1 shows a molecular filter (3), which concentrates oxygen from the air for combustion in the cylinders.

FIG. 1 shows cylinder heads at opposite ends of the cylinders (30L and 30R). The cylinder heads are mirror images of each other with the components of the cylinder head at the left of FIG. 1 given numbers with the letter L appended and the components of the cylinder head at the right of FIG. 1 given the same numbers with the letter R appended.

Figure 2:
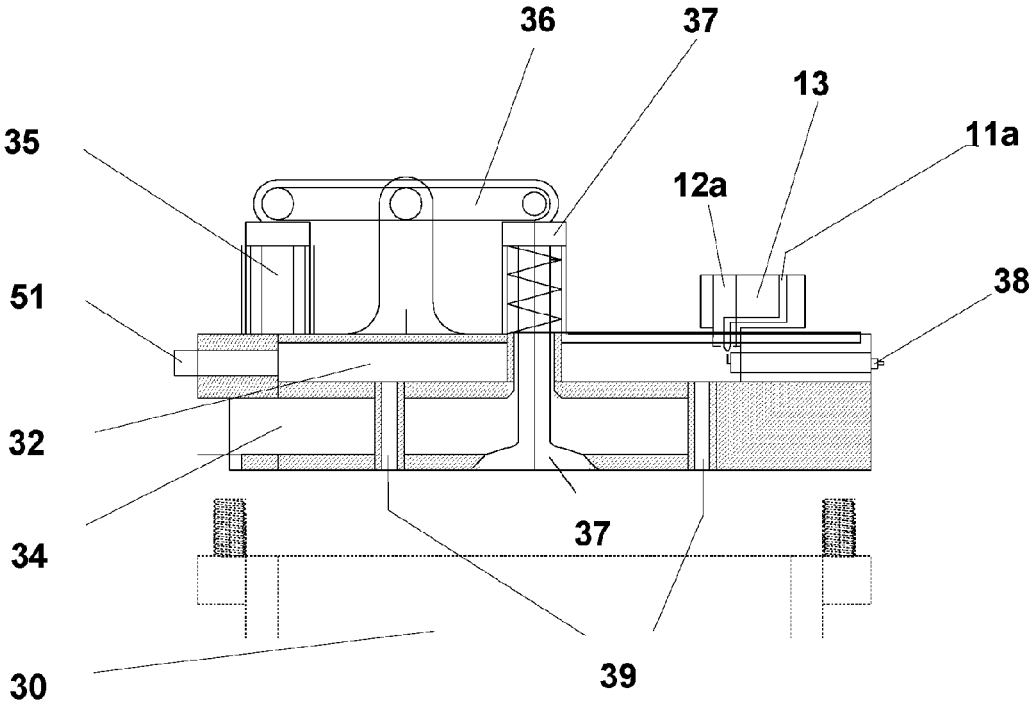
FIG. 2 is an elevation view of the cylinder head.

FIG. 2 is an elevation view of a cylinder head with the L and R designations omitted for clarity. As shown in FIG. 2, The cylinder head is composed of a first chamber (32) that is used for fuel combustion. An injection block (13) is ported to receive injection of oxygen from the oxygen delivery line (12) and the fuel from the fuel delivery line (11). A fuel delivery port (11*a*) and an air or oxygen port (12*a*) enable injection of an ignitable mixture into the combustion chamber (32) when the valve (37) is closed. An igniter (38) ignites the mixture in the combustion chamber (32). The first chamber (32) has passages (39) flowably connecting to the cylinder (30) to which the head is attached. The passages (39) ensure that upon fuel combustion in the first chamber (32), the pressure spike from the combustion gases enters the cylinder (30) to send the dual-headed piston body towards the opposite end of the cylinder.

The cylinder head has a second chamber (34) for exhaust. A valve (37) is operably connected between the second chamber and the cylinder to close prior to fuel combustion and to open prior to fuel combustion in the other cylinder head at the opposite end of the engine block. Although no compression in a cylinder is required for combustion, the engine is capable of creating compression of the exhaust gases, when it is advantageous, such as for example, to slow or stop the returning piston body. Operability of the valve is provided by a valve lifter (35). Common types of valve lifters are pneumatic or solenoid-operated. The valve lifter is connected to the valve via a pivoting rocker arm (36) and the valve (37) is shown with a spring to return the valve to the closed position. A pressure transducer (51) is a sensor that converts the pressure in the combustion chamber into an analog electrical signal to monitor and control the combustion process.

FIG. 1 shows other components that are used in a vehicle application of the preferred embodiment of the invention. An air scoop (1) collects air. As a vehicle is driven, the air scoop collects and partially compresses air from the environment.

A primary compressor (2) compresses, or further compresses, the air for processing.

A molecular filter (3) concentrates oxygen from the compressed air, producing a concentrate of up to 95% pure oxygen. The molecular filter exhausts nitrogen to the environment.

A high pressure compressor (5) compresses the oxygen concentrate and stores it in a high pressure tank (6).

A pump and flow regulator (7) delivers pressurized oxygen to an injection block (13) at the cylinder heads.

A fuel pump and regulator (8) delivers fuel from a fuel storage tank (10) via a fuel delivery line (11) to the injection block (13) at each cylinder head.

Engine operation is controlled by a processor receiving sensor inputs. The processor receives inputs from sensors measuring critical operating parameters of the engine. Preferred sensors measure a linear readout (50) of the piston body position, pressure in each cylinder head combustion chamber from each pressure transducer (51), axle (21) rotation speed from a tachometer (52), oxygen flow rate from the oxygen pump and flow regulator (7), fuel flow rate from a fuel pump and regulator (8), status of each igniter (38) in the cylinder heads, and position of each valve (37) in each cylinder head from a valve position indicator. The processor uses the sensor inputs to control oxygen and fuel flow, operate valves (37) and limit flywheel speed.

The disclosure herein is to be considered as an exemplification of the principles of the invention and is not intended to limit the broad aspect of the invention to the embodiments illustrated. Thus, the scope of the invention is determined by the appended claims and their legal equivalents rather than by the examples given.

What is claimed is:

1. A reciprocating internal combustion engine comprising, (a) an engine block;

(b) a pair of coaxially aligned cylinders in said engine block wherein each cylinder defines a cylinder volume; and, (c) a cylinder head for each cylinder volume, wherein each cylinder head is configured with a first chamber for fuel combustion flowably connected to its cylinder volume for a power stroke, and with a second chamber located between the first chamber and the cylinder volume with connection passages passing through the second chamber to enable a return stroke that avoids compression within such cylinder volume, wherein the cylinder head comprises a valve operably configured to exhaust combustion gases from such cylinder volume through the second chamber.

2. The reciprocating internal combustion engine of claim 1 further comprising a flywheel connected to an axle to rotate in the same direction as the rotation of the axle.

3. The reciprocating internal combustion engine of claim 2 wherein a flywheel slip clutch provides the connection to the axle such that the speed of the flywheel may be controlled by engaging or disengaging the flywheel slip clutch from the axle.

4. The reciprocating internal combustion engine of claim 2 further comprising a second flywheel gearably connected to the axle to rotate in a direction opposite to the direction of rotation of the axle.

5. The reciprocating internal combustion engine of claim 2 further comprising a molecular filter to concentrate oxygen from air for combustion in the cylinders.

6. The reciprocating internal combustion engine of claim 5 further comprising, (a) an air scoop to collect air for combustion;

(b) a primary compressor to compress collected air;

(c) a high pressure compressor to compress oxygen concentrate;

(d) a high pressure oxygen storage tank;

(e) a fuel storage tank;

(f) an injector for each first chamber for fuel combustion to inject fuel and oxygen;

(g) a pump and flow regulator to deliver pressurized oxygen to each injector;

(h) a fuel pump and regulator to deliver fuel from the fuel storage tank to each injector;

(i) a pressure transducer for each first chamber for fuel combustion;

(j) a tachometer to measure flywheel rotational speed;

(k) an oxygen pump and flow regulator;

(l) a fuel pump and regulator;

(m) an igniter for each first chamber for fuel combustion; and, (n) a valve position indicator for each valve.

7. The reciprocating internal combustion engine of claim 6 further comprising sensors adapted to measure operating parameters of the engine, wherein said operating parameters are selected from a group consisting of piston body position, pressure in each cylinder head combustion chamber, axle rotation speed, oxygen flow rate, fuel flow rate, status of each igniter in the cylinder heads, and position of each valve in the cylinder heads.

8. The reciprocating internal combustion engine of claim 7 further comprising a processor to control engine operation and receive inputs from the sensors.

9. The reciprocating internal combustion engine of claim 1 further comprising:

(a) a dual-headed piston body for each said pair of coaxially aligned cylinders comprising first and second piston heads attached to opposite ends of a central frame structure, said first and second piston heads being adapted to reciprocate within respective cylinders of each said pair of coaxially aligned cylinders;

(b) an axle oriented approximately perpendicular to the line of reciprocate motion of each piston body;

(c) two pinion gears for each pair of coaxially aligned cylinders, each said pinion gears rotatably mounted on the axle;

(d) two rack gears mounted within the central frame structure of each said piston body such that each rack gear meshes with one of the pinion gears; and, (e) a slip clutch attached to each pinion gear adapted to alternatively lock to the axle to permit rotation of the axle in one direction as the piston body reciprocates.

10. The reciprocating internal combustion engine of claim 9 wherein one of the rack gears of each said piston body meshes with the top of one of said pinion gears and the other rack gear of each said piston body meshes with the bottom of the other pinion gear.

11. The reciprocating internal combustion engine of claim 9 wherein the slip clutch attached to each pinion gear adapted to alternatively lock to the axle to permit rotation of the axle in only one direction as the piston body reciprocates.

* * * * *